US012760945B2

(12) United States Patent
Li et al.

(10) Patent No.: US 12,760,945 B2
(45) Date of Patent: Oct. 13, 2026

(54) CONDENSING DEVICE AND HEAT PUMP SYSTEM COMPRISING SAME

(71) Applicants: York (Wuxi) Air Conditioning and Refrigeration Co., Ltd., Wuxi (CN); Tyco Fire & Security GmbH, Neuhausen am Rheinfall (CH)

(72) Inventors: Jing Li, Wuxi (CN); Jeb William Schreiber, Milwaukee, WI (US); Xiuping Su, Wuxi (CN); Shimin Sheng, Wuxi (CN); Pei Pei, Wuxi (CN)

(73) Assignees: York (Wuxi) Air Conditioning and Refrigeration Co., Ltd., Wuxi (CN); Tyco Fire & Security GmbH, Neuhausen am Rheinfall (CH)

( * ) Notice: Subject to any disclaimer, the term of this patent is extended or adjusted under 35 U.S.C. 154(b) by 115 days.

(21) Appl. No.: 18/874,540

(22) PCT Filed: Jun. 2, 2023

(86) PCT No.: PCT/CN2023/098032
§ 371 (c)(1),
(2) Date: Dec. 12, 2024

(87) PCT Pub. No.: WO2023/241382
PCT Pub. Date: Dec. 21, 2023

(65) Prior Publication Data

US 2026/0243480 A1 Aug. 20, 2026

(30) Foreign Application Priority Data

Jun. 14, 2022 (CN) ..... 202210670138.7

(51) Int. Cl.
*F25B 39/04* (2006.01)
*F25B 30/02* (2006.01)
(Continued)

(52) U.S. Cl.
CPC ..... *F25B 39/04* (2013.01); *F25B 30/02* (2013.01); *F25B 40/02* (2013.01); *F28D 7/0075* (2013.01); *F28D 7/1646* (2013.01)

(58) Field of Classification Search
CPC ..... F25B 39/04; F25B 30/02; F25B 40/02; F28D 7/0075; F28D 7/1646;
(Continued)

(56) References Cited

U.S. PATENT DOCUMENTS 2,919,903 A * 1/1960 Vautrain ..... F28D 7/1646 165/110
2010/0275643 A1 11/2010 Welch
(Continued)

FOREIGN PATENT DOCUMENTS

CN 104990315 A 10/2015
CN 106196755 A 12/2016
(Continued)

OTHER PUBLICATIONS

PCT International Search Report for PCT Application No. PCT/CN2023/098032, mailed Sep. 19, 2023, 4 pgs.

*Primary Examiner* — Joseph F Trpisovsky
(74) *Attorney, Agent, or Firm* — Fletcher Yoder, P.C.

(57) ABSTRACT

This application discloses a condensing device and a heat pump system including the same. The condensing device includes: a shell; and at least two sets of heat exchange tube bundles, where each set of heat exchange tube bundles includes a condensing tube bundle and a subcooling tube bundle, and the subcooling tube bundle is arranged below the corresponding condensing tube bundle, where the at least two sets of heat exchange tube bundles are configured to circulate the cooling medium independently, to enable the cooling medium in each set of heat exchange tube bundles to perform heat exchange with the refrigerant in the heat exchange accommodating cavity independently. Two sub-
(Continued)

coolers are arranged in a same shell of the condensing device of this application, where one subcooler may be used in an independent refrigeration mode, and the other subcooler may be used in a water heating mode. In the independent refrigeration mode, the subcooler can improve the refrigeration performance of the heat pump system. In the water heating mode, in addition to improving the performance of the heat pump system, the subcooler can further reduce the size of an economizer in the heat pump system, and finally reduce the occupied area of the unit.

10 Claims, 9 Drawing Sheets

(51) Int. Cl.
*F25B 40/02* (2006.01)
*F28D 7/00* (2006.01)
*F28D 7/16* (2006.01)

(58) Field of Classification Search
CPC .... F28D 7/0066; F28D 1/0408; F28D 1/0461; F28D 9/0093
See application file for complete search history.

(56) References Cited

U.S. PATENT DOCUMENTS

| | | | | |
|---|---|---|---|---|
| 2019/0203987 | A1* | 7/2019 | Sheaffer | F28D 7/1646 |
| 2021/0131752 | A1* | 5/2021 | Wu | F28F 9/0131 |
| 2021/0310705 | A1* | 10/2021 | Mei | F25B 39/04 |

FOREIGN PATENT DOCUMENTS

| | | | |
|---|---|---|---|
| CN | 106556185 | A | 4/2017 |
| CN | 107300332 | A | 10/2017 |
| CN | 114076424 | A | 2/2022 |
| CN | 114151986 | A | 3/2022 |
| CN | 114151996 | A | 3/2022 |
| CN | 115164452 | A | 10/2022 |
| DE | 202016104687 | U1 | 9/2016 |
| JP | S4714301 | Y1 | 5/1972 |
| JP | S505255 | U | 1/1975 |
| JP | S6199096 | A | 5/1986 |
| JP | H08233408 | A | 9/1996 |
| JP | 2002022371 | A | 1/2002 |
| JP | 2002205535 | A | 7/2002 |
| JP | 2013526695 | A | 6/2013 |
| JP | 6397246 | B2 | 9/2018 |
| WO | 2020108170 | A1 | 6/2020 |

* cited by examiner

A-A

L

B-B

L

CONDENSING DEVICE AND HEAT PUMP SYSTEM COMPRISING SAME

CROSS-REFERENCE TO RELATED APPLICATIONS

This application is a U.S. National Stage Application of International Application No. PCT/CN2023/098032, entitled "CONDENSING DEVICE AND HEAT PUMP SYSTEM COMPRISING SAME," filed Jun. 2, 2023, which claims priority to and the benefit of Chinese Patent Application No. 202210670138.7, filed Jun. 14, 2022, each of which is hereby incorporated by reference in its entirety for all purposes.

BACKGROUND

Technical Field

This application relates to the field of heat pump systems, and in particular, to a heat pump system including a condensing device.

Related Art

A heat pump system mainly includes components such as a compressor, a condensing device, a throttling device, and an evaporating device, and a refrigerant flows in the components to form a refrigerant circuit. In the refrigerant circuit, a high-pressure gaseous refrigerant discharged out from the compressor first enters the condensing device, and provides heat to a heat exchange medium flowing in a heat exchange tube in the condensing device and is condensed into a high-pressure liquid refrigerant. Then, the high-pressure liquid refrigerant is discharged out from the condensing device to the throttling device, and is throttled into a low-pressure refrigerant in the throttling device. Then, the low-pressure refrigerant enters the evaporating device, and absorbs heat from a heat exchange medium flowing in a heat exchange tube in the evaporating device and is evaporated into a low-pressure gaseous refrigerant. Finally, the low-pressure gaseous refrigerant is discharged out from the evaporating device and returns to the compressor. In this way, the circulation flow of the refrigerant is completed. The refrigerant releases heat and is condensed in the condensing device, thereby providing heat to the outside, and the refrigerant absorbs heat and is evaporated in the evaporating device, thereby providing cool to the outside.

Generally, the heat pump system has a plurality of working modes. In a water heating mode, the heat pump system needs to provide heat to the outside by the condensing device. In an independent refrigeration mode, the heat pump system only needs to provide cool to the outside by the evaporating device, but does not need to provide heat to the outside by the condensing device. In this case, the heat provided in the condensing device needs to be released by a cooling component such as a cooling tower.

SUMMARY

A heat pump system provides heat to the outside through heat exchange between a refrigerant and a heat exchange medium. According to different usages of a condensing device in different working modes of the heat pump system, the heat exchange medium after the heat exchange with the refrigerant needs to transfer heat to different end equipments. In the existing condensing device, two heat exchangers are usually additionally arranged for performing heat exchange again with the heat exchange medium after the heat exchange, to achieve the different usages of heat released by the condensing device.

At least one objective of a first aspect of this application is to provide a condensing device, including: a shell, where the shell has a length direction, a width direction, and a height direction, and a heat exchange accommodating cavity is provided in the shell, and the heat exchange accommodating cavity is used for accommodating a refrigerant; and at least two sets of heat exchange tube bundles, where each set of heat exchange tube bundles is arranged in the heat exchange accommodating cavity and extends in the length direction, the inside of each set of heat exchange tube bundles is used for circulating a cooling medium, each set of heat exchange tube bundles includes a condensing tube bundle and a subcooling tube bundle, and the subcooling tube bundle is arranged below the corresponding condensing tube bundle, where the at least two sets of heat exchange tube bundles are configured to circulate the cooling medium independently, to enable the cooling medium in each set of heat exchange tube bundles to perform heat exchange with the refrigerant in the heat exchange accommodating cavity independently.

According to the first aspect, the condensing device further includes at least two cooling medium accommodating box sets arranged corresponding to the at least two sets of heat exchange tube bundles, each of the cooling medium accommodating box sets includes one pair of cooling medium accommodating boxes, a cooling medium inlet, and a cooling medium outlet, the cooling medium inlet and the cooling medium outlet are arranged on the one pair of cooling medium accommodating boxes, the cooling medium accommodating box is used for accommodating the cooling medium, the cooling medium inlet is configured to input the cooling medium to the cooling medium accommodating box, and the cooling medium outlet is configured to output the cooling medium from the cooling medium accommodating box, where the one pair of cooling medium accommodating boxes are respectively arranged at two ends of the heat exchange tube bundle in the length direction, and the cooling medium inlet and the cooling medium outlet are in fluid communication with the corresponding heat exchange tube bundle through the one pair of cooling medium accommodating boxes, to enable the cooling medium to flow through each set of heat exchange tube bundles independently.

According to the first aspect, the at least two sets of heat exchange tube bundles include a first set of heat exchange tube bundles and a second set of heat exchange tube bundles, the first set of heat exchange tube bundles and the second set of heat exchange tube bundles are arranged on two opposite sides of the shell in the width direction, and the first set of heat exchange tube bundles and the second set of heat exchange tube bundles each have at least one tube pass; and the at least two cooling medium accommodating box sets include a first cooling medium accommodating box set and a second cooling medium accommodating box set, the first cooling medium accommodating box set and the second cooling medium accommodating box set are correspondingly arranged on the two opposite sides of the shell in the width direction.

According to the first aspect, the first cooling medium accommodating box set includes at least one first pass partition plate, and the at least one first pass partition plate is arranged in at least one of the one pair of cooling medium accommodating boxes of the first cooling medium accommodating box set, where the at least one first pass partition plate is configured to enable the first set of heat exchange tube bundles to have at least two tube passes; and the second cooling medium accommodating box set includes at least one second pass partition plate, and the at least one second pass partition plate is arranged in at least one of the one pair of cooling medium accommodating boxes of the second cooling medium accommodating box set, where the at least one second pass partition plate is configured to enable the second set of heat exchange tube bundles to have at least two tube passes.

According to the first aspect, the first set of heat exchange tube bundles and the second set of heat exchange tube bundles have different numbers of tube passes.

According to the first aspect, the shell includes a cylinder and one pair of tube plates, the one pair of tube plates are connected to two ends of the cylinder in the length direction, the cylinder and the one pair of tube plates enclose the heat exchange accommodating cavity, and the one pair of cooling medium accommodating boxes are respectively arranged on outer sides of the one pair of tube plates, where two ends of each of the at least two sets of heat exchange tube bundles in the length direction pass through the one pair of tube plates and are in fluid communication with the cooling medium inlet and the cooling medium outlet of the corresponding one pair of cooling medium accommodating boxes independently.

According to the first aspect, the subcooling tube bundle of each set of heat exchange tube bundles is directly in fluid communication with the corresponding cooling medium inlet, to enable at least one part of the cooling medium inputted from the cooling medium inlet to first flow through the subcooling tube bundle, and then flow through the corresponding condensing tube bundle.

At least one objective of a second aspect of this application is to provide a heat pump system, including: a compressor, a condensing device, a throttling device, and an evaporating device that are arranged in a refrigerant circuit, where the condensing device is the condensing device according to any one item of the first aspect.

According to the second aspect, the at least two sets of heat exchange tube bundles include a first set of heat exchange tube bundles and a second set of heat exchange tube bundles; and the heat pump system has an independent refrigeration mode and an independent water heating mode, where the heat pump system is configured to: circulate, in the independent refrigeration mode, the cooling medium in the first set of heat exchange tube bundles of the condensing device; and circulate, in the independent water heating mode, the cooling medium in the second set of heat exchange tube bundles of the condensing device.

According to the second aspect, the number of tube passes of the first set of heat exchange tube bundles is less than the number of tube passes of the second set of heat exchange tube bundles.

Two subcoolers that independently work are arranged in a same shell of a condensing device of this application. In a heat pump system including the condensing device of this application, one subcooler may be used in an independent refrigeration mode, and the other subcooler may be used in a water heating mode. In the independent refrigeration mode, the subcooler can improve the refrigeration performance of the heat pump system. In the water heating mode, in addition to improving the performance of the heat pump system, the subcooler can further reduce the size of an economizer in the heat pump system, and finally reduce the occupied area of the unit. The performance of the heat pump system is more prominent under a working condition that a temperature difference between inputted water and outputted water of the condensing device is larger.

DETAILED DESCRIPTION

Various embodiments of the present invention will be described below with reference to the accompanying drawings which form a part of this specification. It should be understood that, although directional terms such as "front", "rear", "upper", "lower", "left", "right", "top", "bottom", and the like are used in this application to describe various exemplary structural parts and elements of this application, these terms used herein are only for the convenience of description, and are determined based on exemplary orientations shown in the accompanying drawings. Since the embodiments disclosed in this application may be arranged according to different orientations, these directional terms are only used for illustration and should not be regarded as limitation.

Figure 1A:
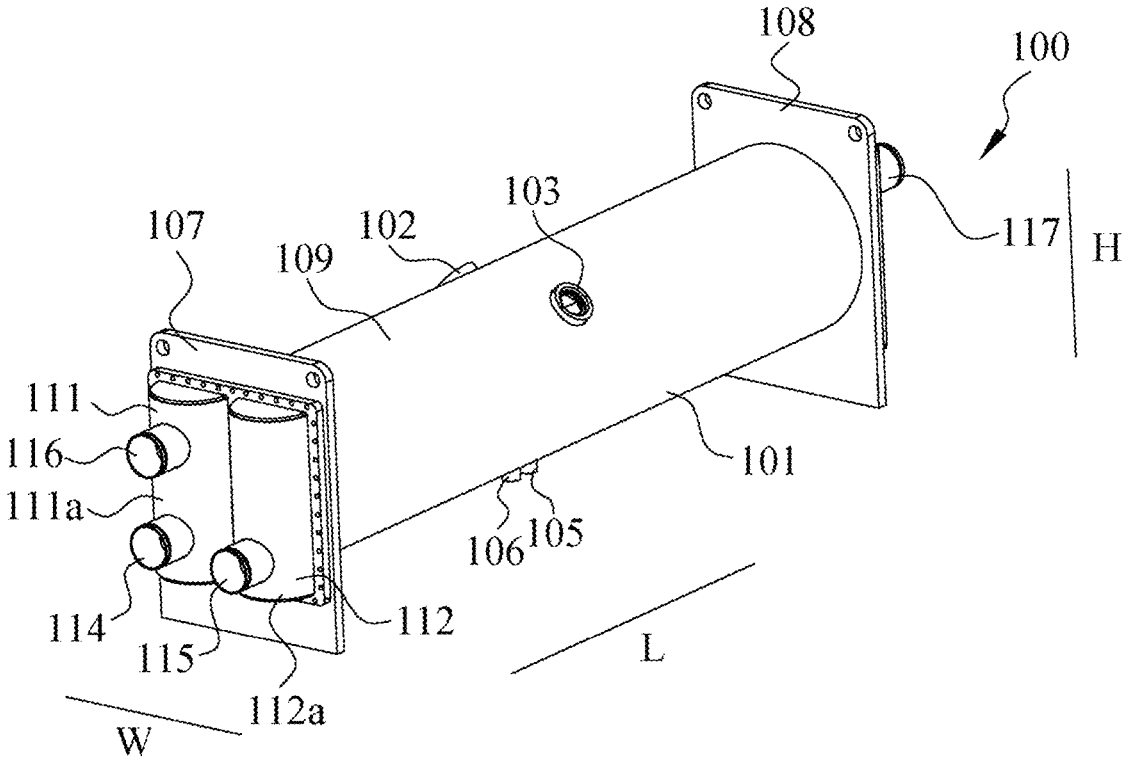
FIG. 1A is a three-dimensional structural diagram of a condensing device from a perspective according to this application.
Figure 1B:
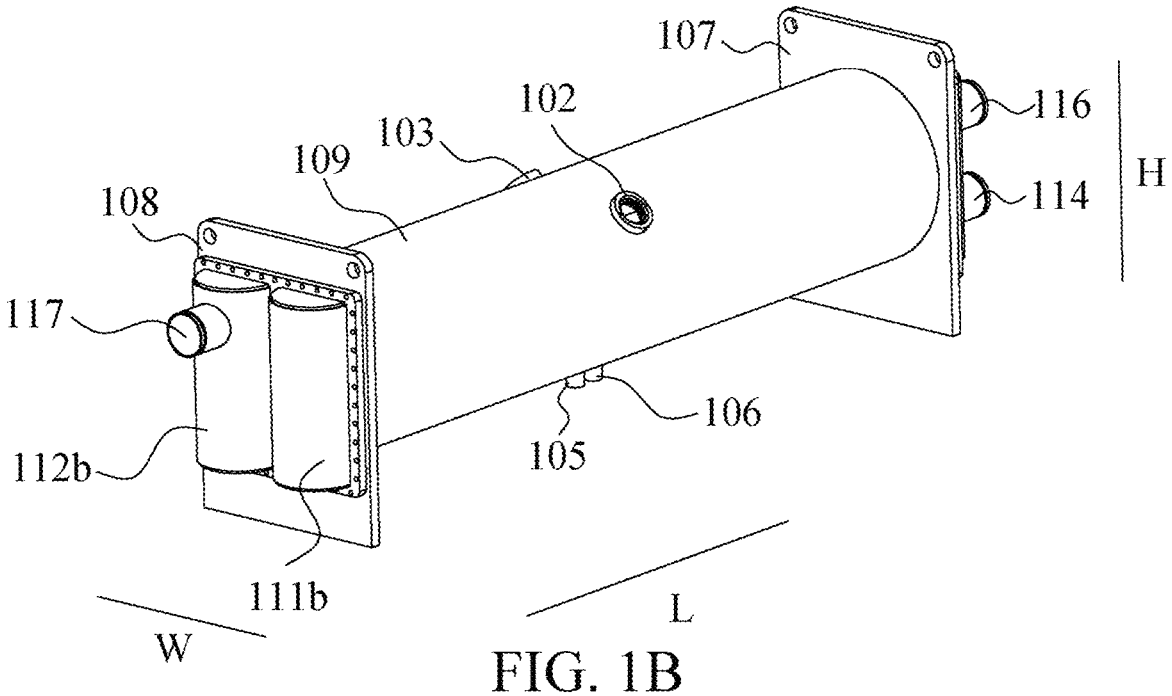
FIG. 1B is a three-dimensional structural diagram of a condensing device from another perspective according to this application.

FIG. 1A and FIG. 1B show three-dimensional structural diagrams of a condensing device 100 from two perspectives according to an embodiment of this application, where FIG. 1A is a three-dimensional structural diagram of the condensing device 100 viewed from front to rear, and FIG. 1B is a three-dimensional structural diagram of the condensing device 100 viewed from rear to front. As shown in FIG. 1A and FIG. 1B, the condensing device 100 includes a shell 101, and the shell 101 has a length direction L, a width direction W, and a height direction H. The inside of the shell 101 is hollow, and has a heat exchange accommodating cavity 220 used for accommodating a refrigerant (shown in FIG. 2). Specifically, the shell 101 includes a cylinder 109 with a substantially cylindrical shape and one pair of tube plates 107 and 108. The one pair of tube plates 107 and 108 are respectively connected to two ends of the cylinder 109 in the length direction L, to close the heat exchange accommodating cavity 220. That is, the cylinder 109 and the one pair of tube plates 107 and 108 enclose the heat exchange accommodating cavity 220. A plurality of holes are arranged on each of the tube plates 107 and 108, to enable heat exchange tube bundles in the heat exchange accommodating cavity 220 to be supported on the tube plates 107 and 108.

The condensing device 100 further includes two refrigerant inlets 102 and 103 and two refrigerant outlets 105 and 106, the refrigerant inlets and the refrigerant outlets are in fluid communication with the heat exchange accommodating cavity 220, so that a gaseous refrigerant can enter the heat exchange accommodating cavity 220 from the refrigerant inlets, and complete heat exchange in the heat exchange accommodating cavity 220 to be condensed into a liquid refrigerant, and then the liquid refrigerant is discharged out from the refrigerant outlets. In this embodiment, the two refrigerant inlets 102 and 103 are arranged at the top of the middle of the cylinder 109, and are respectively located at the top of the cylinder 109 close to a left side and a right side in the width direction W. The two refrigerant outlets 105 and 106 are arranged at the bottom of the middle of the cylinder 109, and are located side by side at the bottom of the cylinder 109 in the length direction L. It can be understood by a person skilled in the art that, because the refrigerant entering the heat exchange accommodating cavity 220 from the refrigerant inlets 102 and 103 is gaseous, the refrigerant inlets 102 and 103 may also be arranged on other positions on the cylinder 109; and because the refrigerant discharged out of the heat exchange accommodating cavity 220 from the refrigerant outlets 105 and 106 is liquid, the refrigerant outlets 105 and 106 generally need to be arranged at the bottom of the cylinder 109. Moreover, in this embodiment, because the heat exchange accommodating cavity 220 of the condensing device 100 includes two sets of heat exchange tube bundles 251 and 252 (shown in FIG. 2), two refrigerant inlets and two refrigerant outlets may be arranged correspondingly. Because the gaseous refrigerant can diffuse in the heat exchange accommodating cavity 220, in other embodiments, the refrigerant inlets and the refrigerant outlets may also be arranged on other positions and in other numbers.

The condensing device 100 further includes cooling medium accommodating box sets. The cooling medium accommodating box sets are configured to accommodate a heat exchange medium, for example, a cooling medium, and be in fluid communication with the inside of heat exchange tube bundles in the condensing device 100. A number of the cooling medium accommodating box sets is configured to correspond to a number of sets of the heat exchange tube bundles in the condensing device 100, so that each cooling medium accommodating box provides the cooling medium to the inside of one set of heat exchange tube bundles. In this embodiment, the cooling medium is water. Because two sets of heat exchange tube bundles are arranged, two cooling medium accommodating box sets are also arranged. In other embodiments, when more or less sets of heat exchange tube bundles are arranged, more or less cooling medium accommodating box sets are also correspondingly arranged The two cooling medium accommodating box sets 111 and 112 are arranged on two opposite sides in the width direction W.

The cooling medium accommodating box set 111 includes one pair of cooling medium accommodating boxes 111*a* and 111*b*, and the cooling medium accommodating box set 112 includes one pair of cooling medium accommodating boxes 112*a* and 112*b*. Specifically, the cooling medium accommodating boxes 111*a* and 112*a* are arranged on the outer sides of the tube plate 107, and the cooling medium accommodating boxes 111*b* and 112*b* are arranged on the outer sides of the tube plate 108. The heat exchange tube bundles 251 and 252 extend in the length direction L, and two ends thereof in the length direction L are respectively supported on the one pair of tube plates 107 and 108, and pass through the tube plates 107 and 108. One pair of cooling medium accommodating boxes of each cooling medium accommodating box set are respectively arranged at two ends of the heat exchange tube bundles 251 and 252 in the length direction L, so that the heat exchange tube bundles 251 and 252 can be in fluid communication with the corresponding cooling medium accommodating boxes, so that the cooling medium in the cooling medium accommodating boxes can flow through the inside of the heat exchange tube bundles 251 and 252.

Each of the cooling medium accommodating box sets 111 and 112 further includes a cooling medium inlet and a cooling medium outlet, the cooling medium inlet is used for inputting the cooling medium to the corresponding cooling medium accommodating box set, and the cooling medium outlet is used for outputting the cooling medium from the corresponding cooling medium accommodating box set. In this embodiment, the cooling medium inlet and the cooling medium outlet of the cooling medium accommodating box set 111 are arranged on a same cooling medium accommodating box, and the cooling medium inlet and the cooling medium outlet of the cooling medium accommodating box set 112 are arranged on different cooling medium accommodating boxes. Specifically, the cooling medium accommodating box set 111 includes a cooling medium inlet 114 and a cooling medium outlet 116, and both the cooling medium inlet 114 and the cooling medium outlet 116 are arranged on the cooling medium accommodating box 111*a*, and are in fluid communication with the inside of the cooling medium accommodating box 111*a*. No corresponding cooling medium inlet and cooling medium outlet are arranged on the cooling medium accommodating box 111*b*. The cooling medium accommodating box set 112 includes a cooling medium inlet 115 and a cooling medium outlet 117, and the cooling medium inlet 115 is arranged on the cooling medium accommodating box 112*a*, and is in fluid communication with the inside of the cooling medium accommodating box 112*a*. The cooling medium outlet 117 is arranged on the cooling medium accommodating box 112*b*, and is in fluid communication with the inside of the cooling medium accommodating box 112*b*. In this embodiment, the cooling medium inlets are arranged below the cooling medium outlets in the height direction H, that is, the cooling medium substantially enters the condensing device from the bottom of the condensing device 100, flows through the inside of the heat exchange tube bundles, and then flows out from the top of the condensing device 100 after performing heat exchange with the refrigerant outside the heat exchange tube bundles. A specific flow path of the cooling medium will be described in detail below with reference to FIG. 3A and FIG. 3B.

Figure 2:
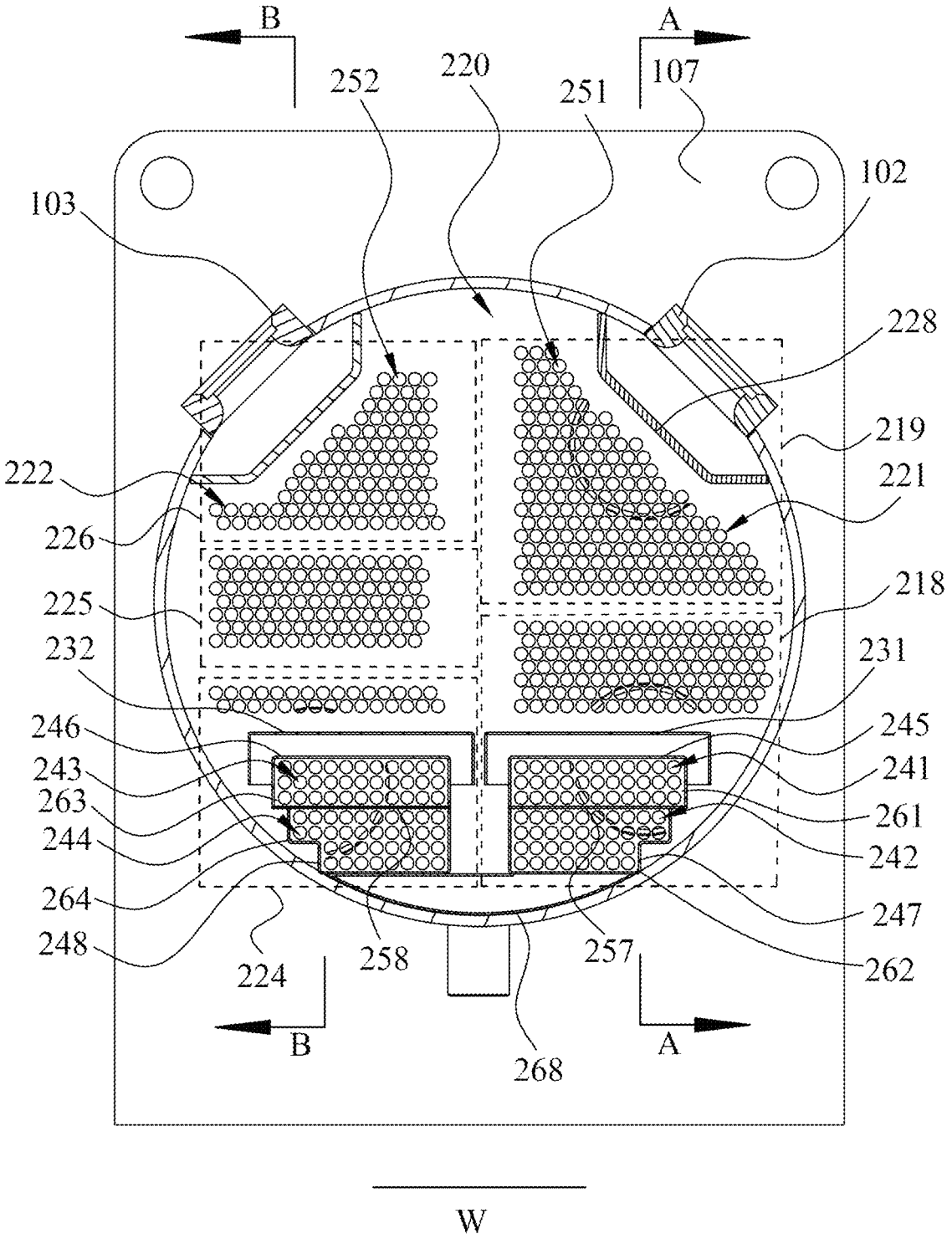
FIG. 2 is a cross-sectional view of a width direction of the condensing device shown in FIG. 1A.

FIG. 2 is a cross-sectional view of the condensing device 100 in a width direction W, which is used for substantially showing a specific structure of the inside of the condensing device 100. In this embodiment, FIG. 2 is a view obtained by vertically cutting the condensing device 100 shown in FIG. 1A from a rear side of the condensing device 100 and observing the condensing device 100 from rear to front. As shown in FIG. 2, the condensing device 100 includes the heat exchange accommodating cavity 220 and the two sets of heat exchange tube bundles 251 and 252. In this embodiment, the first set of heat exchange tube bundles 251 and the second set of heat exchange tube bundles 252 are arranged on two opposite sides of the condensing device 100 in the width direction. The heat exchange accommodating cavity 220 is in fluid communication with refrigerant inlets 102 and 103, to enable the refrigerant to enter the heat exchange accommodating cavity 220 from the refrigerant inlets 102 and 103, and perform heat exchange with a cooling medium circulating in the first set of heat exchange tube bundles 251 and/or the second set of heat exchange tube bundles 252. The condensing device 100 further includes two impingement baffles 228, and the impingement baffles 228 are arranged directly opposite to the refrigerant inlets 102 and 103 respectively, to prevent a gaseous refrigerant from directly impinging the heat exchange tube bundles.

The first set of heat exchange tube bundles 251 is used for being in fluid communication with the cooling medium accommodating box set 111, and the second set of heat exchange tube bundles 252 is used for being in fluid communication with the cooling medium accommodating box set 112. That is, the first set of heat exchange tube bundles 251 and the second set of heat exchange tube bundles 252 are in fluid communication with different cooling medium accommodating box sets. Therefore, the inside of each set of heat exchange tube bundles can circulate the cooling medium independently, so that the cooling medium in each set of heat exchange tube bundles can perform heat exchange with the refrigerant in the heat exchange accommodating cavity 220 independently.

As shown in FIG. 2, in this embodiment, the first set of heat exchange tube bundles 251 and the second set of heat exchange tube bundles 252 have different numbers of tube passes. In an example shown in dashed boxes in FIG. 2, the first set of heat exchange tube bundles 251 has two tube passes, and the second set of heat exchange tube bundles 252 has three tube passes. A dashed box 218 and a dashed box 219 respectively show heat exchange tube bundles in the two tube passes of the first set of heat exchange tube bundles 251. Dashed boxes 224, 225, and 226 respectively show heat exchange tube bundles in the three tube passes of the second set of heat exchange tube bundles 252. It can be understood by a person skilled in the art that, under a same amount of heat exchange, a larger required temperature difference between a cooling medium flowing into a heat exchange tube bundle and the cooling medium flowing out of the heat exchange tube bundle indicates a lower flow rate of the cooling medium. To maintain a flow speed of the cooling medium required by heat exchange, the heat exchange tube bundle has more tube passes. That is, in this embodiment, the cooling medium can achieve a larger temperature difference after flowing through the second set of heat exchange tube bundles 252 compared with flowing through the first set of heat exchange tube bundles 251. The number of tube passes refers to the number of times by which the cooling medium flows through each set of heat exchange tube bundles. A specific flow path of the cooling medium will be described in detail with reference to FIG. 3A and FIG. 3B.

Each set of heat exchange tube bundles includes a condensing tube bundle and a subcooling tube bundle, and the subcooling tube bundle is arranged below the corresponding condensing tube bundle, so that the subcooling tube bundle can further cool the refrigerant after heat exchange through condensation. Specifically, the first set of heat exchange tube bundles 251 includes a condensing tube bundle 221 and subcooling tube bundles 241 and 242, and the subcooling tube bundles 241 and 242 are located below the condensing tube bundle 221. The second set of heat exchange tube bundles 252 includes a condensing tube bundle 222 and subcooling tube bundles 243 and 244, and the subcooling tube bundles 243 and 244 are located below the condensing tube bundle 222.

The condensing device 100 further includes a first subcooler 245 and a second subcooler 246, and the first subcooler 245 and the second subcooler 246 are arranged side by side in the width direction W, and are respectively in fluid communication with the refrigerant outlets 105 and 106. Specifically, the first subcooler 245 is arranged below the condensing tube bundle 221, the first subcooler 245 includes a subcooler shell 247 and the subcooling tube bundles 241 and 242, and the bottom of the first subcooler 245 is in fluid communication with the refrigerant outlet 105. The first subcooler 245 further includes a partition plate 257 and a "C"-shaped cover plate 231. Similarly, the second subcooler 246 is arranged below the condensing tube bundle 222, the second subcooler 246 includes a subcooler shell 248 and the subcooling tube bundles 243 and 244, and the bottom of the second subcooler 246 is in fluid communication with the refrigerant outlet 106. The second subcooler 246 further includes a partition plate 258 and a "C"-shaped cover plate 232. More specific structures of the first subcooler 245 and the second subcooler 246 will be described in detail with reference to FIG. 4A to FIG. 4E.

Therefore, according to this application, by utilizing the feature that the gaseous refrigerant can diffuse in the heat exchange accommodating cavity 220 of the condensing device 100, the gaseous refrigerant in the heat exchange accommodating cavity 220 can selectively perform heat exchange with the cooling medium in one of the sets of heat exchange tube bundles only by controlling the flow path of the cooling medium, so that the gaseous refrigerant is condensed into the liquid refrigerant, and the cooling medium flowing through the set of heat exchange tube bundle is heated. The liquid refrigerant accumulates at the bottom of the cylinder 109, to form a liquid level with a certain height. When a subcooler shell is submerged under the liquid level, the liquid refrigerant can enter the inside of the subcooler shell from a subcooler inlet at the top of the subcooler shell, and perform heat exchange with subcooling tube bundles in the subcooler shell for further cooling. Finally, the subcooled liquid refrigerant that is further cooled is discharged out from a refrigerant outlet.

Moreover, the two sets of heat exchange tube bundles and the two cooling medium accommodating box sets of this embodiment are correspondingly arranged side by side in the width direction W, without affecting a flow path of the gaseous refrigerant substantially flowing from top to bottom, to achieve better condensing and subcooling effects.

Figure 3A:
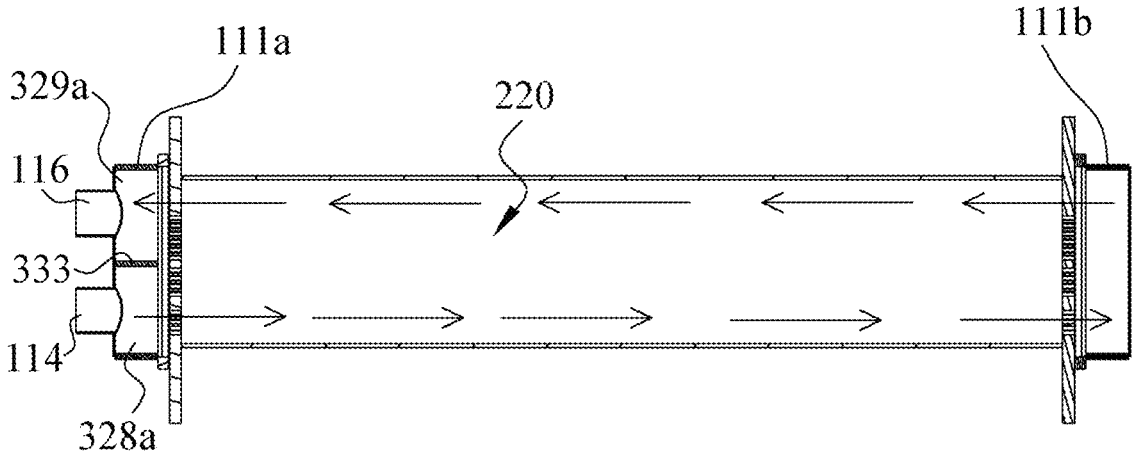
FIG. 3A is a cross-sectional view of a length direction of the condensing device shown in FIG. 1A.
Figure 3B:
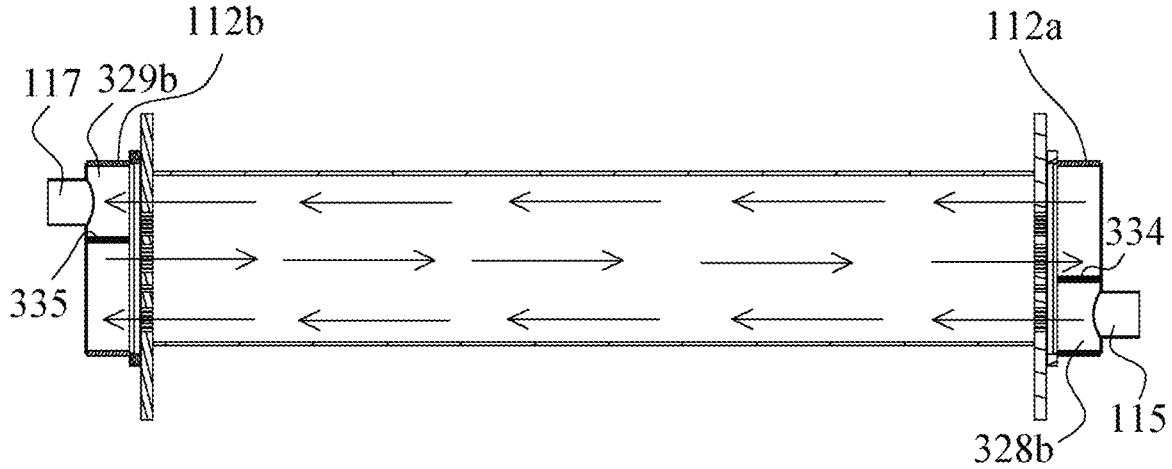
FIG. 3B is a cross-sectional view of another length direction of the condensing device shown in FIG. 1A.

FIG. 3A and FIG. 3B are cross-sectional views of two different length directions of the condensing device 100 along a line A-A and a line B-B in FIG. 2, which are used for showing specific flow paths of a cooling medium. The heat exchange tube bundles are not shown in FIG. 3A and FIG. 3B, and arrows represent the flow paths of the cooling medium.

FIG. 3A shows a flow path of the cooling medium in the cooling medium accommodating box set 111 and the first set of heat exchange tube bundles 251. As shown in FIG. 3A, the cooling medium accommodating box 111*a* includes a pass partition plate 333, and the pass partition plate 333 is transversely arranged in the cooling medium accommodating box 111*a*, to partition the cooling medium accommodating box 111*a* into a water inlet portion 328*a* and a water outlet portion 329*a*, where the water inlet portion 328*a* is located below the water outlet portion 329*a*. In this embodiment, the pass partition plate 333 is substantially arranged at half of a height of the cooling medium accommodating box 111*a*. The cooling medium inlet 114 is arranged on the water inlet portion 328*a*, and the cooling medium outlet 116 is arranged on the water outlet portion 329*a*. No pass partition plate is arranged in the cooling medium accommodating box 111*b*. By arranging the pass partition plate 333, the first set of heat exchange tube bundles 251 has two tube passes.

The cooling medium first enters the water inlet portion 328*a* of the cooling medium accommodating box 111*a* from the cooling medium inlet 114, then flows through one part of the heat exchange tube bundles of the first set of heat exchange tube bundles 251 (namely, the heat exchange tube bundle shown in the dashed box 218 in FIG. 2) substantially from left to right until the cooling medium flows into the cooling medium accommodating box 111*b*, then flows through the other part of the heat exchange tube bundles of the first set of heat exchange tube bundles 251 (namely, the heat exchange tube bundle shown in the dashed box 219 in FIG. 2) substantially from right to left until the cooling medium flows into the water outlet portion 329*a* of the cooling medium accommodating box 111*a*, and finally flows out from the cooling medium outlet 116. Because the cooling medium flows through the first set of heat exchange tube bundles 251 twice, the first set of heat exchange tube bundles 251 has two tube passes.

FIG. 3B shows a flow path of the cooling medium in the cooling medium accommodating box set 112 and the second set of heat exchange tube bundles 252. As shown in FIG. 3B, the cooling medium accommodating box 112*a* includes a pass partition plate 334, and the cooling medium accommodating box 112*b* includes a pass partition plate 335. The pass partition plate 334 and the pass partition plate 335 are transversely arranged in the cooling medium accommodating box 112*a* and the cooling medium accommodating box 112*b* respectively, to partition the cooling medium accommodating box 112*a* into a water inlet portion 328*b*, and partition the cooling medium accommodating box 112*b* into a water outlet portion 329*b*. In this embodiment, the pass partition plate 334 is substantially arranged at two-thirds of a height of the cooling medium accommodating box 112*a*, and the pass partition plate 335 is substantially arranged at one-third of a height of the cooling medium accommodating box 112*b*. The cooling medium inlet 115 is arranged on the water inlet portion 328*b*, and the cooling medium outlet 117 is arranged on the water outlet portion 329*b*. By arranging the pass partition plates 334 and 335, the second set of heat exchange tube bundles 252 has three tube passes.

The cooling medium first enters the water inlet portion 328*b* of the cooling medium accommodating box 112*a* from the cooling medium inlet 115, then flows through one part of the heat exchange tube bundles of the second set of heat exchange tube bundles 252 (namely, the heat exchange tube bundle shown in the dashed box 224 in FIG. 2) substantially from right to left until the cooling medium flows into the cooling medium accommodating box 112*b*, then flows through one part of the heat exchange tube bundles of the second set of heat exchange tube bundles 252 (namely, the heat exchange tube bundle shown in the dashed box 225 in FIG. 2) substantially from left to right until the cooling medium flows back to the cooling medium accommodating box 112*a*, then flows through another part of the heat exchange tube bundles of the second set of heat exchange tube bundles 252 (namely, the heat exchange tube bundle shown in the dashed box 226 in FIG. 2) substantially from right to left until the cooling medium flows into the water outlet portion 329*a* of the cooling medium accommodating box 112*a*, and finally flows out from the cooling medium outlet 117. Because the cooling medium flows through the second set of heat exchange tube bundles 252 thrice, the second set of heat exchange tube bundles 252 has three tube passes.

According to different system requirements, by arranging cooling medium accommodating box sets with different structures, for example, arranging different pass partition plates or positions of cooling medium inlets and cooling medium outlets, the heat exchange tube bundles may also have more or fewer tube passes.

With reference to FIG. 2, FIG. 3A, and FIG. 3B, the cooling medium inlet 114 is directly in fluid communication with the subcooling tube bundles 241 and 242, and is directly in fluid communication with one part of the condensing tube bundle 221 in the dashed box 218. The cooling medium inlet 115 is directly in fluid communication with the subcooling tube bundles 243 and 244, and is directly in fluid communication with one part of the condensing tube bundle 222 in the dashed box 224. In such arrangement, the cooling medium can first flow through the subcooling tube bundles directly, and then flow through the condensing tube bundles sequentially from bottom to top, so that the cooling medium with a lower temperature can be used for subcooling the liquid refrigerant in the subcooling tube bundles.

Figure 4A:
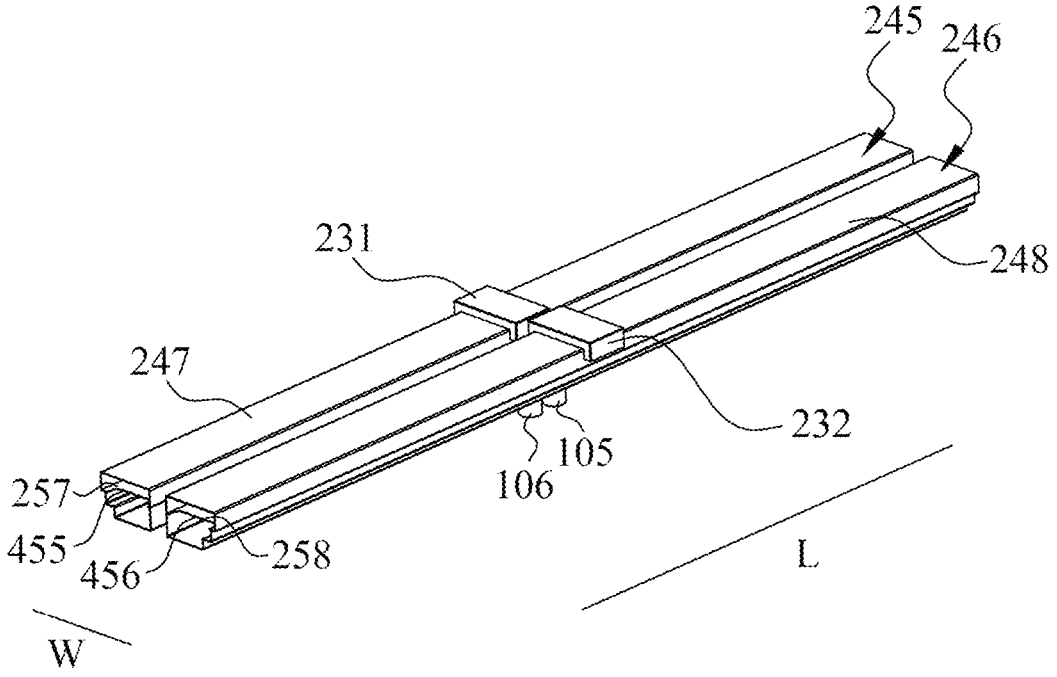
FIG. 4A is a three-dimensional structural diagram of a subcooler in FIG. 1A.
Figure 4B:
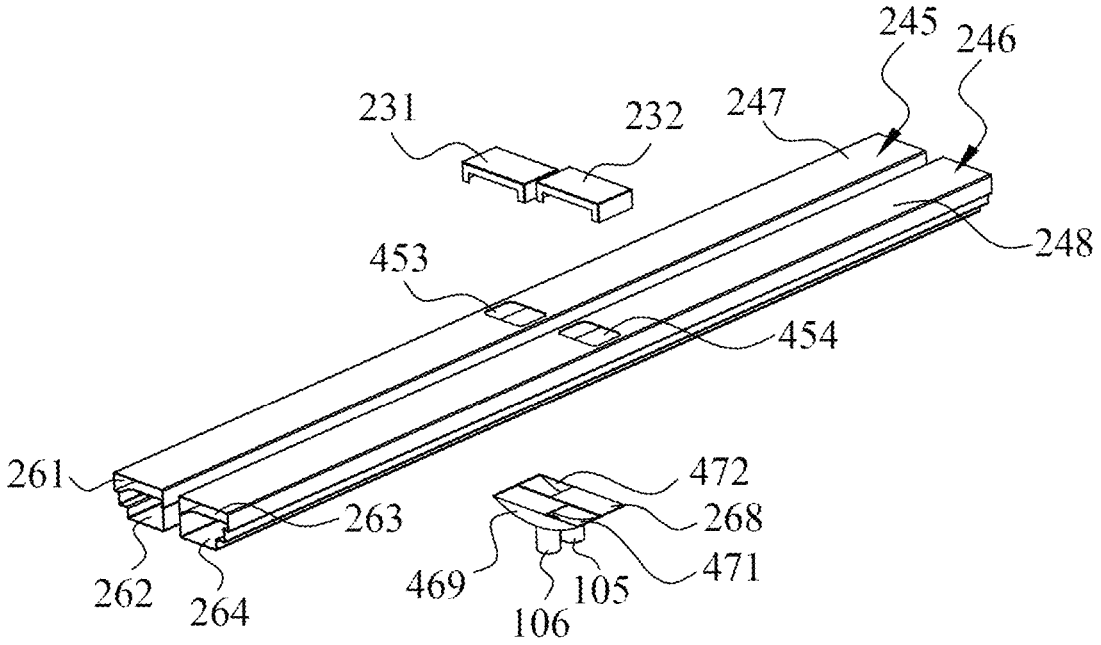
FIG. 4B is an exploded view of the subcooler shown in FIG. 4A from a perspective.
Figure 4C:
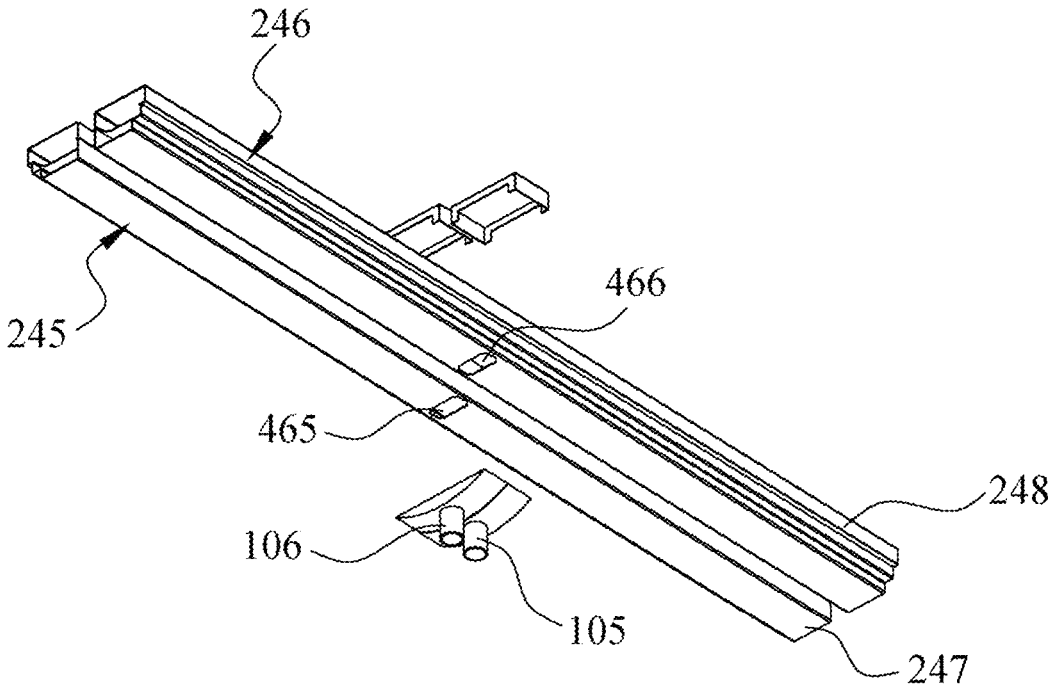
FIG. 4C is an exploded view of the subcooler shown in FIG. 4A from another perspective.
Figure 4D:
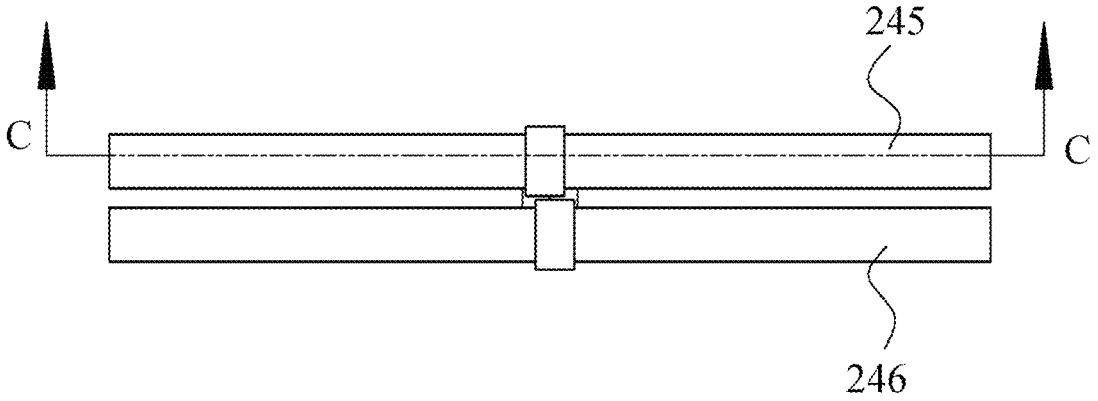
FIG. 4D is a top view of the subcooler shown in FIG. 4A.
Figure 4E:
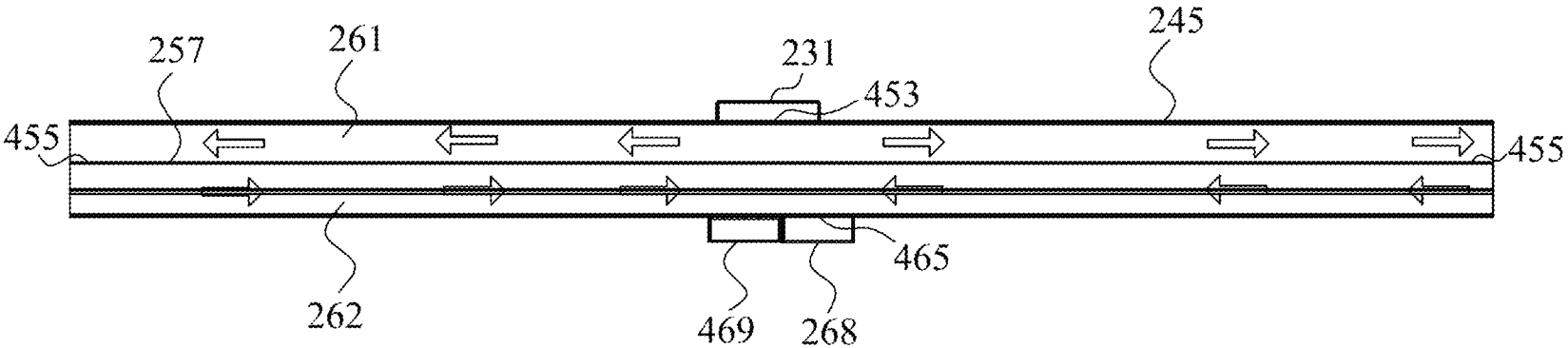
FIG. 4E is a cross-sectional view of the subcooler shown in FIG. 4A.

FIG. 4A to FIG. 4E show specific structures of the first subcooler 245 and the second subcooler 246. FIG. 4A shows a three-dimensional structural diagram of the first subcooler 245 and the second subcooler 246, FIG. 4B shows a three-dimensional exploded view of FIG. 4A from a perspective, FIG. 4C shows a three-dimensional exploded view of FIG. 4A from another perspective, FIG. 4D shows a top view of FIG. 4A, and FIG. 4E shows a cross-sectional view of FIG. 4D along a line C-C. Hollow arrows represent a flow direction of the refrigerant. To show the structures of the subcoolers more clearly, the subcooling tube bundles are not shown.

As shown in FIG. 4A to FIG. 4E, the first subcooler 245 and the second subcooler 246 are arranged side by side in the width direction W, and extend in the length direction L. In this embodiment, the first subcooler 245 is arranged below the condensing tube bundle 221, and the second subcooler 246 is arranged below the condensing tube bundle 222. After performing heat exchange with the cooling medium in the condensing tube bundles, the refrigerant is condensed into the liquid refrigerant, and the liquid refrigerant collects at the bottom of the condensing device, then enters the corresponding subcoolers for further cooling, and is finally discharged out from the corresponding refrigerant outlets.

Specifically, the first subcooler 245 is substantially strip-shaped, and there are end plates (not shown in the figure) at two ends of the subcooler shell 247 of the first subcooler in the length direction L, to close an internal space of the first subcooler 245. There is a top opening 453 substantially on a middle position on the top of the subcooler shell 247, and the liquid refrigerant can enter the inside of the first subcooler 245 from the top opening 453. There is a bottom opening 465 substantially on a middle position on the bottom of the subcooler shell 247, and the further-cooled liquid refrigerant can be discharged out of the first subcooler 245 from the bottom opening 465.

The inside of the first subcooler 245 includes an upper accommodating cavity 261 and a lower accommodating cavity 262, and the partition plate 257 is connected to two ends of the subcooler shell 247 in the width direction W, to partition the upper accommodating cavity 261 and the lower accommodating cavity 262. At least one opening 455 is arranged on the partition plate 257, so that the upper accommodating cavity 261 and the lower accommodating cavity 262 can be in communication with each other through the opening 455. In this embodiment, the at least one opening 455 includes two openings 455, and the two openings 455 are respectively arranged at two ends of the partition plate 257 in the length direction L. The subcooling tube bundle 241 is accommodated in the upper accommodating cavity 261, and the subcooling tube bundle 242 is accommodated in the lower accommodating cavity 262. After entering the first subcooler 245 from the top opening 453, the liquid refrigerant first performs heat exchange with the cooling medium in the subcooling tube bundle 241 in the upper accommodating cavity 261, then flows to the two ends in the length direction L to enter the lower accommodating cavity 262 through the opening 455 and performs heat exchange with the cooling medium in the subcooling tube bundle 242 in the lower accommodating cavity 262, and finally flows to the middle in the length direction L to be discharged out of the first subcooler 245 from the bottom opening 465.

The "C"-shaped cover plate 231 is arranged directly above the top opening 453 of the first subcooler 245, there are gaps for the refrigerant to flow through between two sides and the top of the "C"-shaped cover plate 231 and the corresponding subcooler shell 247, and edges of the gaps are hermetically connected to the corresponding subcooler shell 247, so that the liquid refrigerant forming a liquid level can flow through gaps between the bottom of the "C"-shaped cover plate 231 and side walls of the subcooler shell 247, and enter the inside of the subcooler shell 247 from the top opening 453, thereby preventing the liquid refrigerant from directly entering the inside of the first subcooler 245 from the top opening 453. By arranging the "C"-shaped cover plate 231, the liquid refrigerant can more stably enter the inside of the first subcooler 245.

The first subcooler 245 further includes a semicircular groove 268, and the semicircular groove 268 is connected to the bottom of the first subcooler 245. A shape of the semicircular groove 268 is arranged to match a shape of the bottom of the cylinder 109 (shown in FIG. 2). There is an opening 472 at the top of semicircular groove 268, and the opening 472 is aligned with the bottom opening 465 of the first subcooler 245, to receive the refrigerant discharged out of the first subcooler 245 from the bottom opening 465. The refrigerant outlet 105 is in fluid communication with the semicircular groove 268, and extends out of the cylinder 109 from the bottom of the semicircular groove 268, so that the refrigerant flowing through the first subcooler 245 is discharged out of the condensing device 100.

The structure of the second subcooler 246 is similar to that of the first subcooler 245. The inside of the second subcooler 246 also includes an upper accommodating cavity 263 and a lower accommodating cavity 264 formed by partition of the partition plate 258, and the upper accommodating cavity 263 and the lower accommodating cavity 264 are in communication with each other through two openings 456 at two ends in the length direction L. The subcooling tube bundle 243 is arranged in the upper accommodating cavity 263, and the subcooling tube bundle 244 is arranged in the lower accommodating cavity 264. Moreover, the second subcooler 246 also has a top opening 454 and a bottom opening 466. The "C"-shaped cover plate 232 is arranged directly above the top opening 454, a semicircular groove 469 is connected to the bottom of the second subcooler 246, and an opening 471 of the semicircular groove 469 is aligned with the bottom opening 466. In an example, the top opening 454 of the second subcooler 246 is slightly staggered from the top opening 453 of the first subcooler 245 in the length direction L, and the bottom opening 466 is also slightly staggered from the bottom opening 465 of the first subcooler 245 toward another side. For example, in the figures shown in FIG. 4A to FIG. 4C, the top opening 454 is arranged on a right side of the top opening 453, and the bottom opening 466 is arranged on a left side of the bottom opening 465. In this arrangement, the liquid refrigerant can have a substantially consistent flow distance in the inside of each subcooler, and the semicircular groove 268 and the semicircular groove 469 can be arranged side by side in the length direction L. In other examples, the first subcooler 245 and the second subcooler 246 may also be configured to have the completely same structure.

Further, as shown in FIG. 4D and FIG. 4E, the liquid refrigerant flows separately toward the two ends in the length direction L after entering the upper accommodating cavity 261 of the first subcooler 245 from the top opening 453, and first performs heat exchange with the cooling medium in the subcooling tube bundle 241. Then, the liquid refrigerant enters the lower accommodating cavity 262 from the two openings 455 and flows toward the middle, and performs heat exchange with the cooling medium in the subcooling tube bundle 242. Finally, the liquid refrigerant enters the semicircular groove 268 from the bottom opening 465 substantially on the middle position, and is discharged out from the refrigerant outlet 105. Therefore, the subcooling tube bundle in the first subcooler 245 has two tube passes. A flowing process of the liquid refrigerant in the second subcooler 246 is the same as a flowing process of the liquid refrigerant in the first subcooler 245, and details are not described herein again.

It can be understood by a person skilled in the art that, subcoolers of other structures may also be used in place of the subcoolers of this embodiment.

Figure 5A:
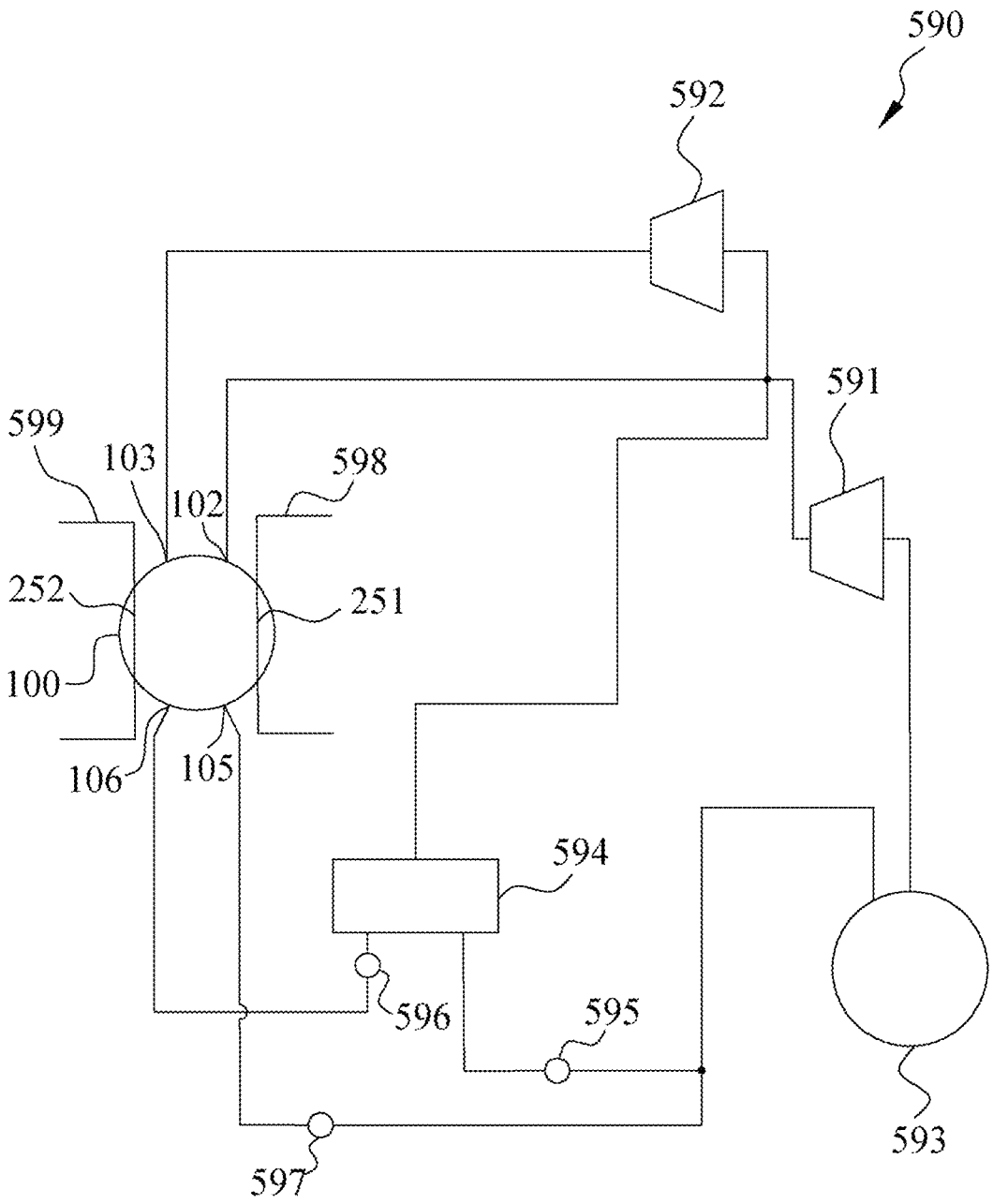
FIG. 5A is a schematic block diagram of a heat pump system according to this application.
Figure 5B:
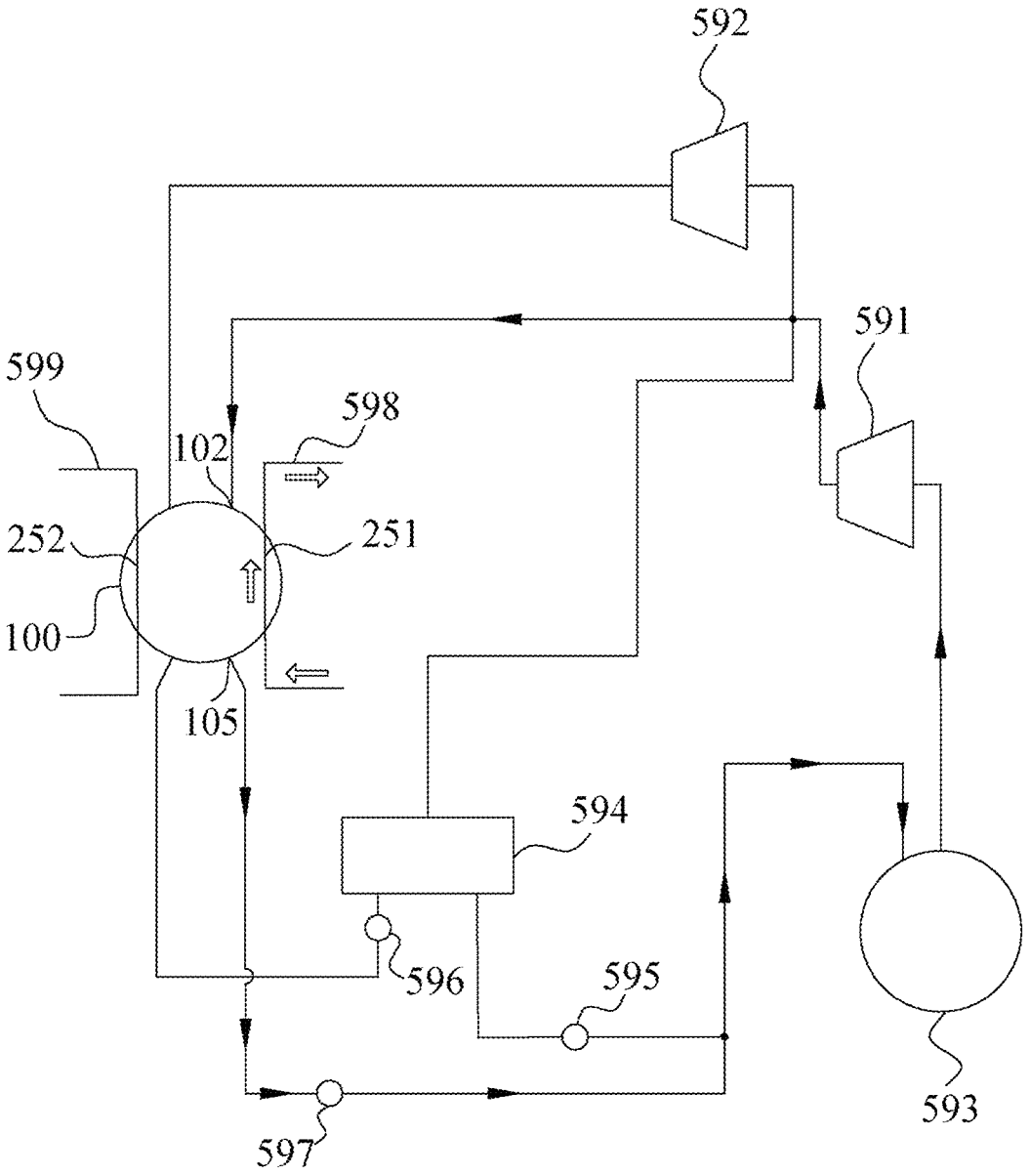
FIG. 5B is a diagram of a flow direction of a refrigerant of the heat pump system shown in FIG. 5A in an independent refrigeration mode.
Figure 5C:
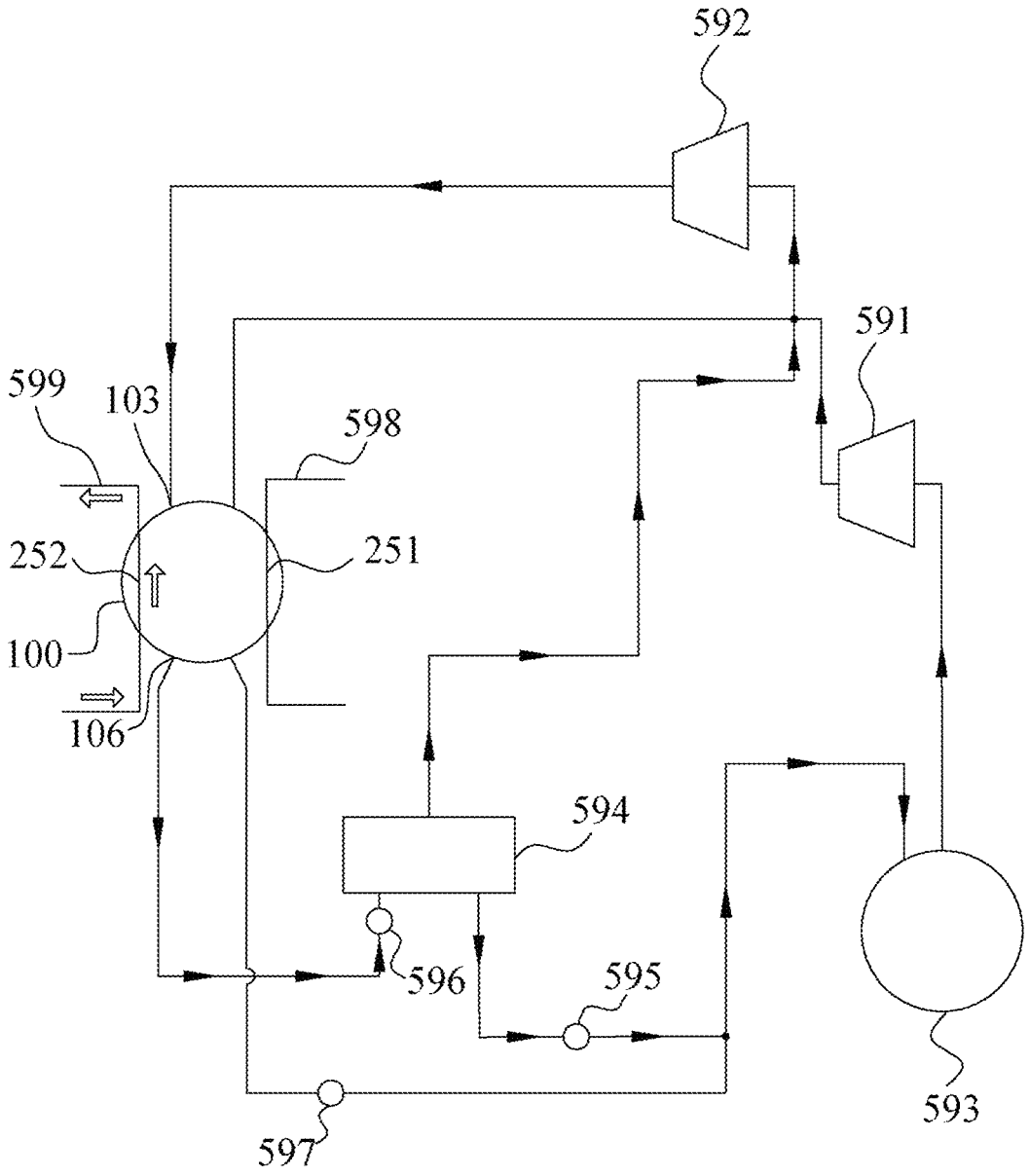
FIG. 5C is a diagram of a flow direction of a refrigerant of the heat pump system shown in FIG. 5A in a water heating mode.

FIG. 5A to FIG. 5C show schematic block diagrams of a heat pump system 590 to which the condensing device 100 of this application is applicable. FIG. 5A shows a structure of the heat pump system 590, FIG. 5B shows a flow direction of a refrigerant of the heat pump system 590 in an independent refrigeration mode, and FIG. 5C shows a flow direction of a refrigerant of the heat pump system 590 in a water heating mode. In this embodiment, solid arrows indicate a flow path of the refrigerant, and hollow arrows indicate a flow path of the cooling medium.

As shown in FIG. 5A to FIG. 5C, the heat pump system 590 is a two-stage compression system, and includes a first-stage compressor 591, a second-stage compressor 592, a condensing device 100, an evaporator 593, an economizer 594, a first throttling device 595, a second throttling device 596, and a third throttling device 597, which are connected by pipes to form a closed system, and the system is charged with a refrigerant. The condensing device 100 includes a first set of heat exchange tube bundles 251 and a second set of heat exchange tube bundles 252.

Specifically, an exhaust port of the first-stage compressor 591 is in fluid communication with a refrigerant inlet 102 of the condensing device 100, a refrigerant outlet 105 of the condensing device 100 is in fluid communication with an inlet of the evaporator 593 through the third throttling device 597, and an outlet of the evaporator 593 is in fluid communication with a suction port of the first-stage compressor 591.

Moreover, an exhaust port of the second-stage compressor 592 is in fluid communication with a refrigerant inlet 103 of the condensing device 100, and a refrigerant outlet 106 of the condensing device 100 is in fluid communication with the economizer 594 through the second throttling device 596. A gas outlet of the economizer 594 is in fluid communication with a suction port of the second-stage compressor 592, a liquid outlet of the economizer 594 is in fluid communication with the inlet of the evaporator 593 through the first throttling device 595, the outlet of the evaporator 593 is in fluid communication with the suction port of the first-stage compressor 591, and the exhaust port of the first-stage compressor 591 is in fluid communication with the suction port of the second-stage compressor 592.

The heat pump system 590 further includes a water supply and return pipe 598 and a water supply and return pipe 599, and the water supply and return pipe 598 and the water supply and return pipe 599 are used for circulating a cooling medium. The water supply and return pipe 598 is in fluid communication with the inside of the first set of heat exchange tube bundles 251 in the condensing device 100, and the water supply and return pipe 599 is in fluid communication with the inside of the second set of heat exchange tube bundles 252 in the condensing device 100. In this embodiment, the water supply and return pipe 598 is used for being in fluid communication with a cooling tower (not shown in the figures), to re-cool the heated cooling medium flowing through the water supply and return pipe 598 to a required temperature. The water supply and return pipe 599 is used for being in fluid communication with an end equipment, to provide the heated cooling medium flowing through the water supply and return pipe 599 to the end equipment for hot water supply.

In the heat pump system 590 in this embodiment, in different working modes, the cooling medium flowing out of each set of heat exchange tube bundles has different temperatures. In an example, the cooling medium flowing out of the heat exchange tube bundles has a higher temperature in the water heating mode, and the cooling medium has a lower temperature in the refrigeration mode. Therefore, in the refrigeration mode, only the first-stage compressor 591 needs to be used, and the economizer 594 does not need to be used. However, in the water heating mode, the first-stage compressor 591 and the second-stage compressor 592 need to be used simultaneously, and the economizer 594 further needs to be used for improving the performance of the heat pump system.

Therefore, by controlling the operation of the first-stage compressor 591, the second-stage compressor 592, the first throttling device 595, the second throttling device 596, and the third throttling device 597, and selecting the water supply and return pipe 598 or the water supply and return pipe 599 for circulating the cooling medium, the heat pump system 590 can have a plurality of working modes, for example, can include at least the independent refrigeration mode, the independent water heating mode, and a simultaneous refrigeration and water heating mode. FIG. 5B shows a diagram of a flow direction of a refrigerant and a cooling medium of the heat pump system 590 in the independent refrigeration mode. FIG. 5C shows a diagram of a flow direction of a refrigerant and a cooling medium of the heat pump system 590 in the independent water heating mode or the simultaneous refrigeration and water heating mode.

As shown in FIG. 5B, in the independent refrigeration mode, the water supply and return pipe 598 and the first set of heat exchange tube bundles 251 are used for circulating the cooling medium, the evaporator 593 is used for refrigerating the outside, the second-stage compressor 592 is stopped from running, the first-stage compressor 591 is kept running, the first throttling device 595 and the second throttling device 596 are in a closed state, and the third throttling device 597 is in an open state.

A high-pressure gaseous refrigerant discharged out from the first-stage compressor 591 enters a heat exchange accommodating cavity 220 through the refrigerant inlet 102 of the condensing device 100, and performs heat exchange with the cooling medium in the first set of heat exchange tube bundles 251. The high-pressure gaseous refrigerant is first condensed into a high-pressure liquid refrigerant by the cooling medium in a condensing tube bundle 221 in the heat exchange accommodating cavity 220, and then the high-pressure liquid refrigerant is further cooled into a high-pressure subcooled liquid refrigerant by subcooling tube bundles 241 and 242 in a first subcooler 245. The high-pressure subcooled liquid refrigerant is then discharged out through the refrigerant outlet 105 of the condensing device 100 and flows into the third throttling device 597, and is throttled into a low-pressure two-phase refrigerant, and then the low-pressure two-phase refrigerant flows into the evaporator 593. The low-pressure two-phase refrigerant performs heat exchange with the cooling medium (not shown in the figure) in the evaporator 593 to absorb heat and be evaporated into a low-pressure gaseous refrigerant. Finally, the low-pressure gaseous refrigerant flows out from the evaporator 593 and re-flows into the first-stage compressor 591, thereby completing the circulation of the refrigerant.

In this case, the cooling medium flowing through the first set of heat exchange tube bundles 251 is heated by the high-pressure gaseous refrigerant, and is outputted to the cooling tower (not shown in the figure) through the water supply and return pipe 598, to reduce the temperature of the cooling medium again by heat dissipation of the cooling tower, so that the cooling medium can enter the condensing device 100 again to perform heat exchange with the refrigerant. Moreover, the cooling medium (not shown in the figure) in the evaporator 593 is cooled, thereby providing cool to the end equipment (not shown in the figure).

As shown in FIG. 5C, in the water heating mode, for example, in the independent water heating mode or the simultaneous refrigeration and water heating mode, the water supply and return pipe 599 and the second set of heat exchange tube bundles 252 are used for circulating the cooling medium, and the evaporator 593 may not refrigerate the outside or cool the outside. The first-stage compressor 591 and the second-stage compressor 592 are run simultaneously, and the first throttling device 595 and the second throttling device 596 are in the open state. The third throttling device 597 is in the closed state.

A high-pressure gaseous refrigerant discharged out from the second-stage compressor 592 enters the heat exchange accommodating cavity 220 through the refrigerant inlet 103 of the condensing device 100, and performs heat exchange with the cooling medium in the second set of heat exchange tube bundles 252. The high-pressure gaseous refrigerant is first condensed into a high-pressure liquid refrigerant by the cooling medium in a condensing tube bundle 222 in the heat exchange accommodating cavity 220, and then the high-pressure liquid refrigerant is further cooled into a high-pressure subcooled liquid refrigerant by subcooling tube bundles 243 and 244 in a second subcooler 246. The high-pressure subcooled liquid refrigerant is then discharged out through the refrigerant outlet 106 of the condensing device 100 and flows into the second throttling device 596, and is throttled into a medium-pressure two-phase refrigerant, and then the medium-pressure two-phase refrigerant flows into the economizer 594. In the economizer 594, gas-liquid separation is performed on the medium-pressure two-phase refrigerant, an obtained gaseous refrigerant is directly discharged out to the suction port of the second-stage compressor 592, a medium-pressure liquid refrigerant in the economizer is throttled into a low-pressure liquid refrigerant through the first throttling device 595, and then the low-pressure liquid refrigerant flows into the evaporator 593. The low-pressure liquid refrigerant performs heat exchange with the cooling medium (not shown in the figure) in the evaporator 593 to absorb heat and be evaporated into a low-pressure gaseous refrigerant. The low-pressure gaseous refrigerant flows out from the evaporator 593 and re-flows into the first-stage compressor 591. After the low-pressure gaseous refrigerant is compressed for the first time in the first-stage compressor 591, an obtained gaseous refrigerant enters the second-stage compressor 592 and is compressed for the second time, thereby completing the circulation of the refrigerant.

In this case, the cooling medium flowing through the second set of heat exchange tube bundles 252 is heated by the high-pressure gaseous refrigerant, and is outputted to the end equipment (not shown in the figure) through the water supply and return pipe 599, to provide heat to the outside by providing hot water to the end equipment, so that the cooling medium that has released heat can enter the condensing device 100 again to perform heat exchange with the refrigerant. Similarly, the cooling medium in the evaporator 593 is cooled. When the cooled cooling medium is not in fluid communication with the end equipment, for example, when the cool is directly released to the external environment, the heat pump system 590 is in the independent water heating mode. When the cooled cooling medium is in fluid communication with the end equipment, the heat pump system 590 is in the simultaneous refrigeration and water heating mode.

It can be understood by a person skilled in the art that, the condensing device 100 of this application is also applicable to heat pump systems with other structures.

In the heat pump system, in the independent refrigeration mode and the water heating mode, the cooling medium for circulating to the cooling tower and the cooling medium for circulating to the end equipment to provide hot water in the condensing device need to be provided separately. In some existing heat pump systems, only one set of heat exchange tube bundles is used in the condensing device for heat exchange with the refrigerant. Therefore, two heat exchange devices need to be provided additionally, to respectively transfer the heat of the cooling medium heated after heat exchange to the cooling tower or the end equipment. Alternatively, a heat pump system needs to have two condensing devices to be respectively used in the independent refrigeration mode and the water heating mode.

In the condensing device of this application, two independent sets of heat exchange tube bundles are arranged in one shell, so that cooling mediums of different usages can flow in different tube bundles, for example, a cooling medium circulating to a cooling tower and a cooling medium circulating to an end equipment can separately flow in corresponding heat exchange tube bundles, and perform heat exchange with a gaseous refrigerant filling a heat exchange accommodating cavity, to meet the requirements of a plurality of modes of a heat pump system, thereby preventing two cooling mediums of different usages from contaminating hot water due to mixing.

Moreover, in the condensing device of this application, because two independent sets of heat exchange tube bundles are arranged, each set of heat exchange tube bundles can be arranged with different numbers of tube passes according to requirements, so that the cooling medium flowing into and out of each set of heat exchange tube bundles can meet different temperature difference requirements. For example, in a water heating mode, by selecting a first set of heat exchange tube bundles with a larger number of tube passes to circulate the cooling medium, the cooling medium flowing into and out of the heat exchange tube bundles can have a larger temperature difference. In an independent refrigeration mode, by selecting a second set of heat exchange tube bundles with a smaller number of tube passes to circulate the cooling medium, the cooling medium flowing into and out of the heat exchange tube bundles can have a smaller temperature difference.

In addition, each set of heat exchange tube bundles of the condensing device of this application includes respective condensing tube bundles and subcooling tube bundles, so that regardless of the set of heat exchange tube bundles through which the cooling medium flows, the refrigerant can be condensed and subcooled in sequence. Especially, in the water heating mode, a condensed liquid refrigerant can be subcooled into a subcooled liquid refrigerant, to improve the working efficiency of an economizer. Under the same conditions, the size required for the economizer is smaller, which can reduce the occupied space of the heat pump system.

Although this application will be described with reference to the specific embodiments shown in the accompanying drawings, it should be understood that the condensing device and the refrigeration system of this application can have many variations without departing from the spirit, scope, and context of this application. A person of ordinary skill in the art will also recognize that various ways to vary structural details of the embodiments disclosed in this application are all within the spirit and scope of the present invention and claims.

What is claimed is:

1. A condensing device, comprising:

a shell, wherein the shell has a length direction (L), a width direction (W), and a height direction (H), and a heat exchange accommodating cavity is provided in the shell, and the heat exchange accommodating cavity is configured to accommodate a refrigerant; and at least two sets of heat exchange tube bundles, wherein each set of heat exchange tube bundles is arranged in the heat exchange accommodating cavity and extends in the length direction (L), an inside of each set of heat exchange tube bundles is configured to circulate a cooling medium, each set of heat exchange tube bundles comprises a condensing tube bundle and a subcooling tube bundle, and the subcooling tube bundle is arranged below the corresponding condensing tube bundle, wherein the at least two sets of heat exchange tube bundles are each configured to circulate the cooling medium independently to enable the cooling medium in each set of heat exchange tube bundles to exchange heat with the refrigerant in the heat exchange accommodating cavity independently.

2. The condensing device of claim 1, wherein:

the condensing device further comprises at least two cooling medium accommodating box sets arranged corresponding to the at least two sets of heat exchange tube bundles, each of the cooling medium accommodating box sets comprises one pair of cooling medium accommodating boxes, a cooling medium inlet, and a cooling medium outlet, the cooling medium inlet and the cooling medium outlet are arranged on the one pair of cooling medium accommodating boxes, the cooling medium accommodating box is used for accommodating configured to accommodate the cooling medium, the cooling medium inlet is configured to input the cooling medium to the cooling medium accommodating box, and the cooling medium outlet is configured to output the cooling medium from the cooling medium accommodating box, wherein the one pair of cooling medium accommodating boxes are respectively arranged at two ends of the corresponding heat exchange tube bundle in the length direction (L), and the cooling medium inlet and the cooling medium outlet are in fluid communication with the corresponding heat exchange tube bundle through the one pair of cooling medium accommodating boxes to enable the cooling medium to flow through each set of heat exchange tube bundles independently.

3. The condensing device of claim 2, wherein:

the at least two sets of heat exchange tube bundles comprise a first set of heat exchange tube bundles and a second set of heat exchange tube bundles, the first set of heat exchange tube bundles and the second set of heat exchange tube bundles are arranged on two opposite sides of the shell in the width direction (W), and the first set of heat exchange tube bundles and the second set of heat exchange tube bundles each have at least one tube pass; and the at least two cooling medium accommodating box sets comprise a first cooling medium accommodating box set and a second cooling medium accommodating box set, and the first cooling medium accommodating box set and the second cooling medium accommodating box set are correspondingly arranged on the two opposite sides of the shell in the width direction (W).

4. The condensing device of claim 3, wherein:

the first cooling medium accommodating box set comprises at least one first pass partition plate, and the at least one first pass partition plate is arranged in at least one of the one pair of cooling medium accommodating boxes of the first cooling medium accommodating box set, wherein the at least one first pass partition plate is configured to enable the first set of heat exchange tube bundles to have at least two tube passes; and the second cooling medium accommodating box set comprises at least one second pass partition plate, and the at least one second pass partition plate is arranged in at least one of the one pair of cooling medium accommodating boxes of the second cooling medium accommodating box set, wherein the at least one second pass partition plate is configured to enable the second set of heat exchange tube bundles to have at least two tube passes.

5. The condensing device of claim 4, wherein:

the first set of heat exchange tube bundles and the second set of heat exchange tube bundles have different numbers of tube passes.

6. The condensing device of claim 2, wherein:

the shell comprises a cylinder and one pair of tube plates, the one pair of tube plates are connected to two ends of the cylinder in the length direction (L), the cylinder and the one pair of tube plates enclose the heat exchange accommodating cavity, and the one pair of cooling medium accommodating boxes are respectively arranged on outer sides of the one pair of tube plates, wherein two ends of each of the at least two sets of heat exchange tube bundles in the length direction (L) pass through the one pair of tube plates to be in fluid communication with the cooling medium inlet and the cooling medium outlet of the corresponding one pair of cooling medium accommodating boxes independently.

7. The condensing device of claim 2, wherein:

the subcooling tube bundle of each set of heat exchange tube bundles is directly in fluid communication with the corresponding cooling medium inlet, to enable at least one part of the cooling medium inputted from the cooling medium inlet to first flow through the subcooling tube bundle and then flow through the corresponding condensing tube bundle.

8. A heat pump system, comprising:

a compressor, a condensing device, a throttling device, and an evaporating device arranged in a refrigerant circuit, wherein the condensing device is the condensing device according to claim 1.

9. The heat pump system of claim 8, wherein:

the at least two sets of heat exchange tube bundles comprise a first set of heat exchange tube bundles and a second set of heat exchange tube bundles; and the heat pump system has an independent refrigeration mode and an independent water heating mode, wherein the heat pump system is configured to:

circulate, in the independent refrigeration mode, the cooling medium in the first set of heat exchange tube bundles of the condensing device; and circulate, in the independent water heating mode, the cooling medium in the second set of heat exchange tube bundles of the condensing device.

10. The heat pump system of claim 9, wherein:

a first number of tube passes of the first set of heat exchange tube bundles is less than a second number of tube passes of the second set of heat exchange tube bundles.

* * * * *